US005766394A

United States Patent [19]

Anderson et al.

[11] Patent Number: 5,766,394

[45] Date of Patent: Jun. 16, 1998

[54] METHOD FOR FORMING A POLYCRYSTALLINE LAYER OF ULTRA HARD MATERIAL

[75] Inventors: Nathan R. Anderson, Pleasant Grove; Ronald K. Eyre, Orem; Madapusi K. Keshavan; Ghanshyam Rai, both of Sandy, all of Utah

[73] Assignee: Smith International, Inc., Houston, Tex.

[21] Appl. No.: 568,276

[22] Filed: Dec. 6, 1995

Related U.S. Application Data

[60] Provisional application No. 60/003,466 Sep. 8, 1995.

[51] Int. Cl.[6] ..... B32B 31/26; B22F 1/00; B22F 3/14

[52] U.S. Cl. ..... 156/89.11; 264/15; 264/657; 51/297; 51/307; 419/33; 419/36; 419/43; 419/54

[58] Field of Search ..... 156/89; 264/60, 264/63, 66, 125, 15; 51/293, 297, 298, 307, 309; 76/101.1, DIG. 12; 419/8, 13, 14, 33, 36, 43, 65, 69, 23, 48, 54

[56] References Cited

U.S. PATENT DOCUMENTS

| | | | |
|---|---|---|---|
| 3,574,580 | 4/1971 | Stromberg et al. | 51/307 |
| 3,743,566 | 7/1973 | Breton et al. | 156/62.8 |
| 3,778,586 | 12/1973 | Breton et al. | 219/76 |
| 4,104,441 | 8/1978 | Fedoseev et al. | 264/109 X |
| 4,194,949 | 3/1980 | Breton et al. | 428/308 |
| 4,861,350 | 8/1989 | Phaal et al. | 51/295 X |
| 4,866,885 | 9/1989 | Dodsworth | 51/295 X |
| 4,931,068 | 6/1990 | Dismukes et al. | 51/293 |
| 5,037,451 | 8/1991 | Burnand et al. | 51/293 |
| 5,089,070 | 2/1992 | McAndrew | 156/89 |
| 5,211,726 | 5/1993 | Slutz et al. | 51/293 |
| 5,248,317 | 9/1993 | Tank et al. | 51/293 |
| 5,320,990 | 6/1994 | Guiton et al. . | |
| 5,366,679 | 11/1994 | Streicher . | |
| 5,379,853 | 1/1995 | Lockwood et al. | 51/307 X |
| 5,468,268 | 11/1995 | Tank et al. | 51/293 |
| 5,620,489 | 4/1997 | Tselesin | 51/293 |

FOREIGN PATENT DOCUMENTS 1212681 11/1970 United Kingdom .

OTHER PUBLICATIONS

Ragan Technologies Incorporated, High Shear Compaxtion Technology; 14 pages. Ragan Technologies Inc. Presents: . . . ZST . . . LTCC; 9 pages.

A New Hardfacing Process, Dustoor, et al, Imperial Clevite Inc., 1982 National Power Metallurgy Conference, Montreal, Can. May 24–27 Process in Powder Metallurgy, vol. 38, pp. 1–16.

Air Products and Chemicals, Inc.—QPAC Binders, 12 pages; Laboratory Report, The Role of Slip Additives in Tape–Casting Technology, vol. 71, #10, Oct. 1992.

*Primary Examiner*—Curtis Mayes

*Attorney, Agent, or Firm*—Christie, Parker & Hale, LLP

[57] ABSTRACT

A polycrystalline diamond layer is bonded to a cemented metal carbide substrate by this process. A layer of dense high shear compaction material including diamond or cubic boron nitride particles is placed adjacent to a metal carbide substrate. The particles of diamond have become rounded instead of angular due to high shear compaction in a multiple roller process. The volatiles in the high shear compaction material are removed and binder decomposed at high temperature, for example, 950° C., leaving residual amorphous carbon or graphite in a layer of ultra hard material particles on the carbide substrate. The substrate and layer assembly is then subjected to a high pressure, high temperature process, thereby sintering the ultra hard particles to each other to form a polycrystalline ultra hard layer bonded to the metal carbide substrate. The layer of high shear compaction material is also characterized by a particle size distribution including larger and smaller particles that are distributed uniformly throughout the layer.

18 Claims, 6 Drawing Sheets

FIG. 1
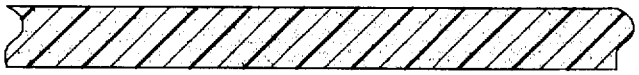
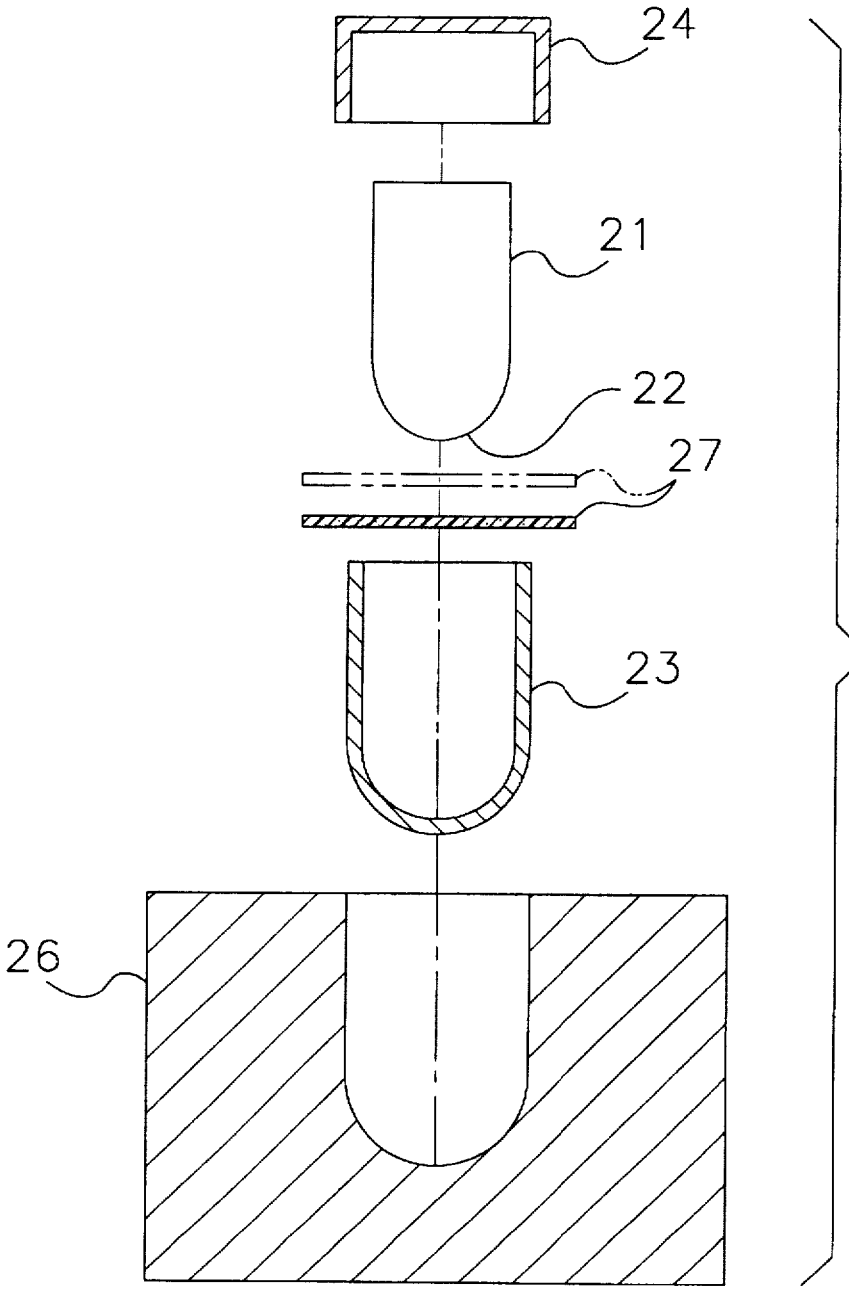
FIG. 2

METHOD FOR FORMING A POLYCRYSTALLINE LAYER OF ULTRA HARD MATERIAL

The present application is based on Provisional Application No. 60/003,466 filed Sep. 8, 1995.

FIELD OF THE INVENTION

This invention relates in general to polycrystalline diamond composite compacts.

More specifically, this invention relates to a method of making polycrystalline diamond (PCD) or cubic boron nitride (PCBN) composite compacts that are considerably improved over compacts taught in the prior art. This method combines high shear compaction technology and high pressure/temperature processing to form the strong coherent composite compacts.

BACKGROUND

Composite PCD compacts composed of ultra hard particles sintered and bonded to a cemented carbide substrate have well known applications in industry for applications such as cutting tools and drill bit cutters. Most commercially available PCD or PCBN composite compacts are made according to the teachings of U.S. Pat. No. 3,745,623, for example, whereby a relatively small volume of ultra hard particles is sintered as a thin layer (approx. 0.5 to 1.3 mm) onto a cemented tungsten carbide substrate.

Generally speaking the process for making a compact employs a body of cemented tungsten carbide where the tungsten carbide particles are cemented together with cobalt. The carbide body is placed adjacent to a layer of diamond particles and the combination is subjected to high temperature at a pressure where diamond is thermodynamically stable. This results in recrystallization and formation of a polycrystalline diamond layer on the surface of the cemented tungsten carbide. The layer of diamond crystals may include tungsten carbide particles and/or small amounts of cobalt. Cobalt promotes the formation of polycrystalline diamond and if not present in the layer of diamond, cobalt will infiltrate from the cemented tungsten carbide substrate.

Although this method is satisfactory for many applications, it is always desirable to provide a compact with greater impact resistance, uniformity and ease of manufacture. Furthermore, available methods for forming a polycrystalline diamond layer are difficult when putting the layer on a nonplanar surface.

The present invention is directed to a method of producing a PCD composite compact using techniques and processes referred to herein as "high shear compaction" in conjunction with high pressure, high temperature technology. High pressure, high temperature process refers to processing at a sufficiently elevated pressure and temperature that diamond or cubic boron nitride is thermodynamically stable. The process is sometimes referred to as being conducted in a superpressure press. Pressures are typically 65 kilobars or more and temperature may exceed 2000° C. This part of the process is conventional.

Some of the processing is common to what is known as "tape casting". Tape casting is most commonly used in the electronics industry to fabricate ceramic coatings, substrates and multi-layer structures. A process of bonding a thin PCD layer directly to a preformed planar or non-planar surface on a metal carbide substrate using the high pressure, high temperature diamond tape cast process is described in U.S. patent application Ser. No. 08/026,890, now abandoned.

In that process, a fine ceramic or cermet powder is mixed with a temporary organic binder. This mixture is mixed and milled to the most advantageous viscosity and then cast or calendared into a sheet (tape) of a desired thickness. The tape is dried to remove water or organic solvents. The dried tape is flexible and strong enough in this state to be handled and cut into shapes needed to conform to the geometry of the corresponding substrate using a temporary adhesive. The tape/substrate assembly is initially heated in a vacuum furnace to a temperature high enough to drive off the temporary adhesive and/or binder material. The temperature is then raised to a level where the ceramic or cermet powders fuse to each other and/or to the substrate, thereby producing a very uniform continuous ceramic or cermet coating bonded to the substrate.

It is desirable to have a PCD or PCBN composite compact with improved impact resistance or toughness, wear resistance, uniformity and ease of manufacture.

SUMMARY OF THE INVENTION

The present invention provides an improved method of forming a polycrystalline ultra hard layer bonded to a cemented metal carbide substrate. A layer of dense high shear compaction material including diamond or cubic boron nitride particles is placed adjacent to a metal carbide substrate. The particles of ultra hard material have become rounded instead of angular due to high shear compaction. The volatiles in the high shear compaction material are decomposed at high temperature, for example, 950° C., leaving residual carbon in a layer of ultra hard material particles on the carbide substrate. The substrate and layer assembly is then subjected to a high pressure, high temperature process, thereby sintering the ultra hard particles to each other to form a polycrystalline ultra hard layer bonded to the metal carbide substrate. The layer of high shear compaction material is also characterized by a particle size distribution including larger and smaller particles that are distributed uniformly throughout the layer.

BRIEF DESCRIPTION OF THE DRAWINGS

FIG. 1 is a cross-sectional view of a sheet of high shear compaction material.

FIG. 2 is a partially sectioned exploded view of components used to fabricate the embodiment of the invention shown in FIG. 3.

DETAILED DESCRIPTION

Figure 3:
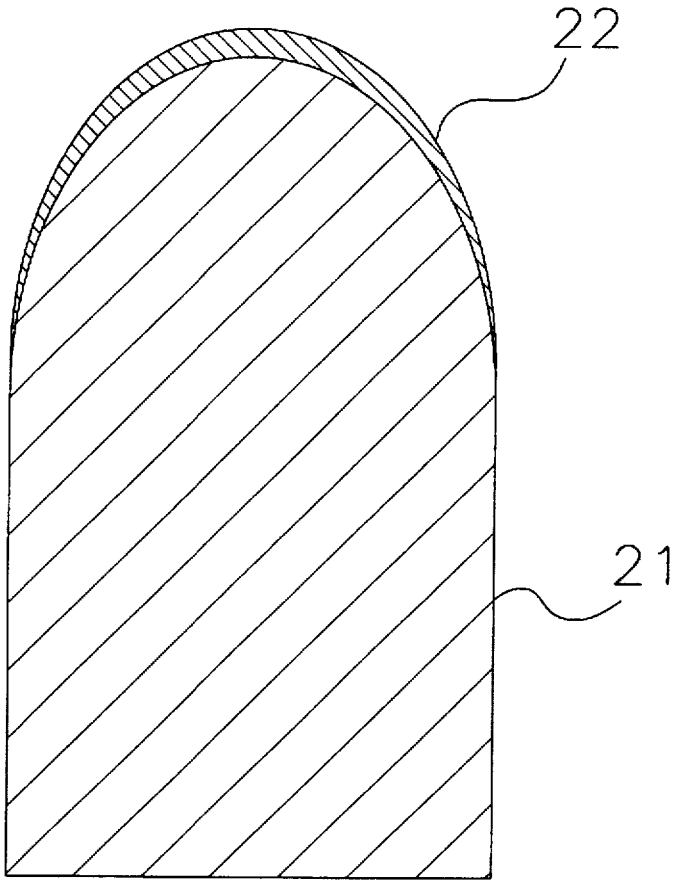
FIG. 3 is a cross-sectional view of a rock bit insert made according to the present invention.

FIG. 1 illustrates a sheet of high shear compaction material 20 processed by Ragan Technologies, 5631 Palmer Way, Suite A, Carlsbad, Calif. 92008. The high shear compaction material is composed of particles of ultra hard material such as diamond or cubic boron nitride, an organic binder such as polypropylene carbonate and possibly residual solvents such as methyl ethyl ketone (MEK). The sheet of high shear compaction material is prepared in a multiple roller process. For example, a first rolling (pass) in a multiple roller high shear compaction process produces a sheet approximately 0.25 mm thick. The sheet is then lapped over itself and rolled for a second time, producing a sheet of about 0.45 mm in thickness. The sheet may either be folded or cut and stacked to have multiple layer thickness.

This compaction process produces a high shear in the tape and results in extensive mastication of the ultra hard particles, breaking off corners and edges but not cleaving them and creating a volume of relatively smaller particles in situ. This process also results in thorough mixing of the particles, which produces a uniform distribution of the larger and smaller particles throughout the high shear compaction material. The breakage rounds the particles without cleaving substantial numbers of the particles.

Also, high shear during the rolling process produces a sheet of high density, i.e. about 2.5 to 2.7 g/cm$^3$, and preferably about 2.6±0.05 g/cm$^3$. This density is characteristic of a sheet having about 80% by weight diamond crystals and 20% organic binder. At times, it is desirable to include tungsten carbide particles and/or cobalt in the sheet. There may also be times when a higher proportion of binder and lower proportion of diamond particles may be present in the sheet for enhanced "drapability". The desired density of the sheet can be adjusted proportionately and an equivalent sheet produced.

The sheet of high shear compaction material is characterized by a high green density, resulting in low shrinkage during firing. For example, sheets used on substrates with planar surfaces have densities of about 70% of theoretical density. The high density of the sheet and the uniform distribution of particles produced by the rolling process tend to result in less shrinkage during the pre-sinter heating step and pre-sintered ultra hard layers with very uniform particle distribution, which improves the results obtained from the high pressure, high temperature process.

FIG. 2 illustrates in exploded view components used to fabricate a PCD composite article, in this case an insert for a rock bit. Such an insert comprises a cemented tungsten carbide body 21 which may have a variety of conventional shapes as are commonly employed in rock bits. As an adequate example for purposes of describing the process, an exemplary insert has a cylindrical body with a hemispherical end 22. An "enhanced insert" as made in practice of this invention has a layer of polycrystalline diamond on the hemispherical end.

The enhanced insert is made in a cup 23 having an inside geometry complementary to the geometry of the insert. The cup and a cap 24 are typically made of niobium or other refractory metal. The cup is placed in a temporary die or fixture 26 having a cavity that is complementary to the outside of the cup. One or more layers 27 of high shear compaction sheet containing diamond crystals or the like, is placed in the hemispherical end of the cup. In effect, the cup serves as a mold for shaping the layer.

Figure 4:
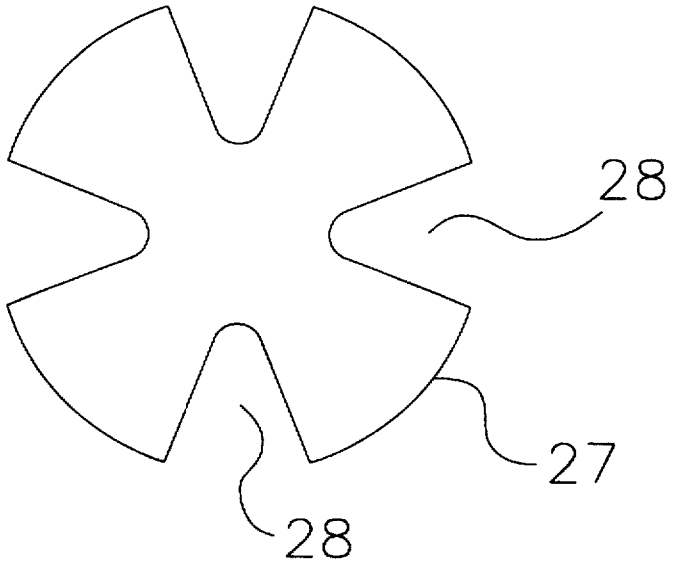
FIG. 4 is a plan view of a preform of high shear compaction material employed in the assembly of FIG. 2.

Each such layer comprises a preform cut from a sheet of high shear compaction material. An exemplary preform, as illustrated in FIG. 4 for fitting on the hemispherical end of an insert, comprises a circular disk with four generally V-shaped notches 28 extending from the circumference toward the center. The notches permit the flat preform to bend into the hemispherical form of the cup without extensive folding, buckling or doubling of thickness.

The insert, or a punch having the same shape as the insert, is then pressed into the cup to smooth the layer of high shear compaction material to a substantially uniform thickness in the end of the cup. When making an axisymmetric insert or the like, such a punch may be rotated to aid in smoothing the high shear compaction material. If multiple layers of high shear compaction material are employed in the cup, they are preferably introduced one at a time and individually smoothed. Slightly different punch shapes may be used for successive layers to account for the increased thickness of material within the cup.

After the material is smoothed, the insert body is placed in the cup (if not already there from smoothing) and the cup is removed from the die 26.

The organic binder in the high shear compaction material is then removed, leaving the diamond crystals in the cup. Preferably the organic material is removed after an insert is placed in the cup, but alternatively the organic material may be removed before the insert is placed in the cup.

The organic material in the high shear compaction layer or layers is "dewaxed" by heating the assembly in vacuum to a temperature of about 1025° C. Heating may also be in an inert or reducing gas such as argon or ammonia. The latter may be beneficial when the ultra hard material applied to an insert or other body is cubic boron nitride.

Conventional dewaxing practice for removing organic binder from high shear compaction materials has been to heat at temperatures in the order of 300° to 600° C. Surprisingly, it has been found that by heating at temperatures of at least 950° C., there are significantly enhanced results due to the high temperature processing. The reasons for this are not completely understood, however, it is believed that the enhanced results are a consequence of thermal decomposition of the binder material and deoxidation by residual carbon.

The temperature for pretreating the high shear compaction material containing ultra hard particles is preferably 950° C. or more. It has been found, for example, that heating in vacuum at 950° C. for several hours is suitable for diamond containing material. A temperature of 1025° C. for a shorter period also gives good results. A higher temperature may be used for cubic boron nitride particles and it may be desirable to heat CBN in ammonia for maintaining stoichiometry of the CBN and reducing surface oxides. It has also been found that heating rate can be significant and a low heating rate is desirable. It is believed that vaporization of volatile materials in the binder may lead to minute "blistering" at high heating rates. Volatiles produced in the dewaxing may not escape readily from the high shear compaction sheet and cause delamination. Significantly improved results are obtained with a heating rate of about 2° C. per minute as compared with a heating rate of about 5° C. per minute.

An exemplary cycle for dewaxing, i.e. the removal of binder from the sheet material by heating, has a heating rate of 2° C. per minute to a temperature of 500° C. The temperature is held at 500° C. for two hours. Heating is then resumed with a heating rate of up to 5° C. per minute to 950° C. Temperature is held at 950° C. for six hours followed by cooling at a rate of 2° C. per minute.

The heating to and holding at a temperature of about 500° C. is similar to conventional dewaxing. Slow heating is desirable so that the rate of decomposition of organic material in the binder is not faster than the rate of dissipation of the decomposition products through the layer of ultra hard material particles. Otherwise, delamination may occur.

After dewaxing, the layer of ultra hard material is heated to a much higher temperature for reducing oxides formed before or during the high shear compaction process. The reduction of oxides is facilitated by residual carbon on the particles formed by decomposition of the organic binder materials. For diamond a temperature of at least 950° C. is important. A higher temperature may be used with cubic boron nitride. Carbon on cubic boron nitride particles also facilitates deoxidation.

Once the organic binder has been removed from the high shear compaction material, a refractory metal cap 24 is placed around and over the open end of the cup 23. The inside of the cap fits somewhat snugly around the outside of the cup. This assembly is then passed through a die which "swages" the cap into tight engagement with the outside of the cup, effectively sealing the cemented carbide body and layer of diamond crystals inside the resulting "can." Such an assembly is placed in a graphite sleeve heater, surrounded by salt and the heater is placed in a block of pyrophyllite or analogous material. This is a conventional assembly which is placed in the high pressure, high temperature press for forming the enhanced insert with a layer of PCD on its end.

An assembly containing the carbide body and layer of diamond particles is placed in a super pressure press where it is pressed at pressures where diamond is thermodynamically stable, such as in excess of 35 kilobars and as much as 65 kilobars. While maintaining such high pressures, the material in the press is heated to elevated temperature for a short period until polycrystalline diamond is formed. During this heating cycle, cobalt included in the diamond particle mixture or infiltrated from the cemented tungsten carbide is present within the mass of diamonds. To form polycrystalline diamond and have grain growth, there is mass transfer of carbon. The solubility of carbon in the liquid cobalt phase promotes such recrystallization and consolidation of the polycrystalline diamond.

After pressing, the metal can is stripped from the completed insert. The outside cylindrical surface of the insert is typically ground to a precise finish suitable for insertion in a rock bit.

It is believed that residual carbon from thermal decomposition of the binder remains on surfaces of the diamond crystals. This may be amorphous carbon, graphite or other low temperature form that is stable at lower temperature and pressure than in a superpressure press. Raman spectroscopy discloses graphite peaks, indicating that the carbon formed by heating of the organic binder is at least in part in the form of graphite. Such carbon is also very finely divided and can readily dissolve in the cobalt phase. Easy solution of the carbon in the cobalt phase is believed to facilitate recrystallization and formation of polycrystalline diamond. Formation of the residual carbon in situ in the mass of diamond crystals seems to be important since simply mixing amorphous carbon with the diamond crystals has not been shown to give the same results.

Another factor in achieving good results with the high shear compaction material relates to the particle size distribution of the diamond crystals in the high shear compaction material. The shape of the particles is also involved.

Some previous attempts to employ sheet material with ultra hard particles in an organic binder for forming a rock bit insert have involved a different process for preparing the tape cast material. According to that process, the organic binder and the particles to be used are dissolved and suspended in an organic or aqueous solvent. A slurry of such material is placed on a flat surface and calendared to give a uniform thickness. The resulting sheet is gently heated to remove much of the solvent, thereby leaving a sheet of tape cast material. Sheets prepared by this process have not proved to be satisfactory for forming rock bit inserts.

According to this invention, however, the sheet material is made by multiple roller process so that the diamonds are subjected to considerable shear and mastication as the material passes between rotating rolls. The high shear compaction of the sheet abrades diamond crystals against each other, thereby somewhat reducing the particle size. The lubrication and suspension provided by the organic binder phase is believed to contribute to the high shear extending essentially through the entire thickness of the layer for uniform treatment of the diamond crystals.

The abrasion of particles against each other results in breakage which may include cleavage of crystals and fractures of corners and edges which are knocked off of larger crystals as a consequence of the high shear processing of the high shear compaction sheet. It is found to be desirable to limit the mastication to have breakage of corners and edges to produce equiaxed or rounded particles instead of cleavage which produces angular particles with lower surface energy.

A multimodal particle size distribution is also desirable in the sheet to be employed for forming polycrystalline diamond. It is known, for example, that there is better packing density in a powder mixture when there are two or more different sizes of particles instead of particles that are all one size. This principle can be visualized by considering balls of various sizes. For example, if a volume is filled with soccer balls it will have a certain maximum density since there are void spaces between the balls regardless of how they are packed. If one then adds marbles to the volume filled with soccer balls, it will be seen that some of the void spaces are occupied by these smaller particles and the total density of packing within the volume becomes larger. Even higher packing density may be obtained by trimodal particle size distribution than with bimodal soccer balls and marbles.

For this reason, it is desirable to commence formation of the sheet material with a nonuniform distribution of particle sizes.

Figure 5:
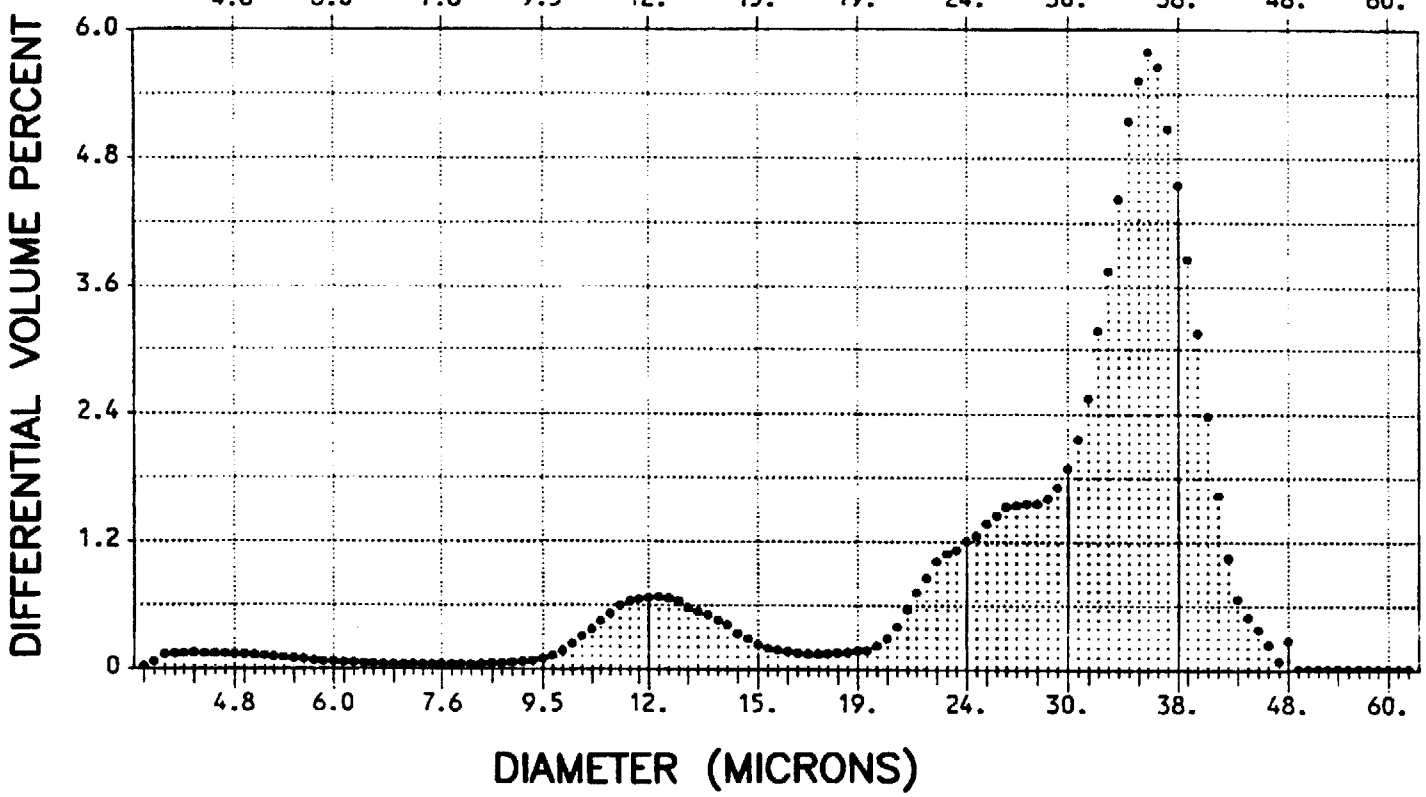
FIG. 5 is a graph of particle-size distribution of an ultra hard material used for making a high shear compaction material.

FIG. 5 illustrates a graph of the differential of volume of any given particle size as a function of particle size. This is a log-linear plot where the particle size is plotted on a logarithmic scale. In effect, this curve represents the slope of a graph of total volume of particles below a given size as a function of size.

Three different particle sizes were employed to make up the original mixture. One portion of the particles had an average particle size of about 12 microns, another portion had an average particle size of about 27 microns and the largest portion had an average particle size of about 36 microns. Each of the average size ranges of diamond powder used to make this trimodal mixture comprises a mix of particles having the stated average size, with actual particle sizes in a bell shaped distribution around the average, typically with an elongated "tail" of fine particles.

This mixture had a particle size distribution as illustrated in FIG. 5 before forming into a high shear compaction sheet. The tenth percentile volume of this material is 12.9 microns. In other words, 10 percent of the volume of diamond powder is represented by particles up to 12.9 microns in "diameter."

Figure 6:
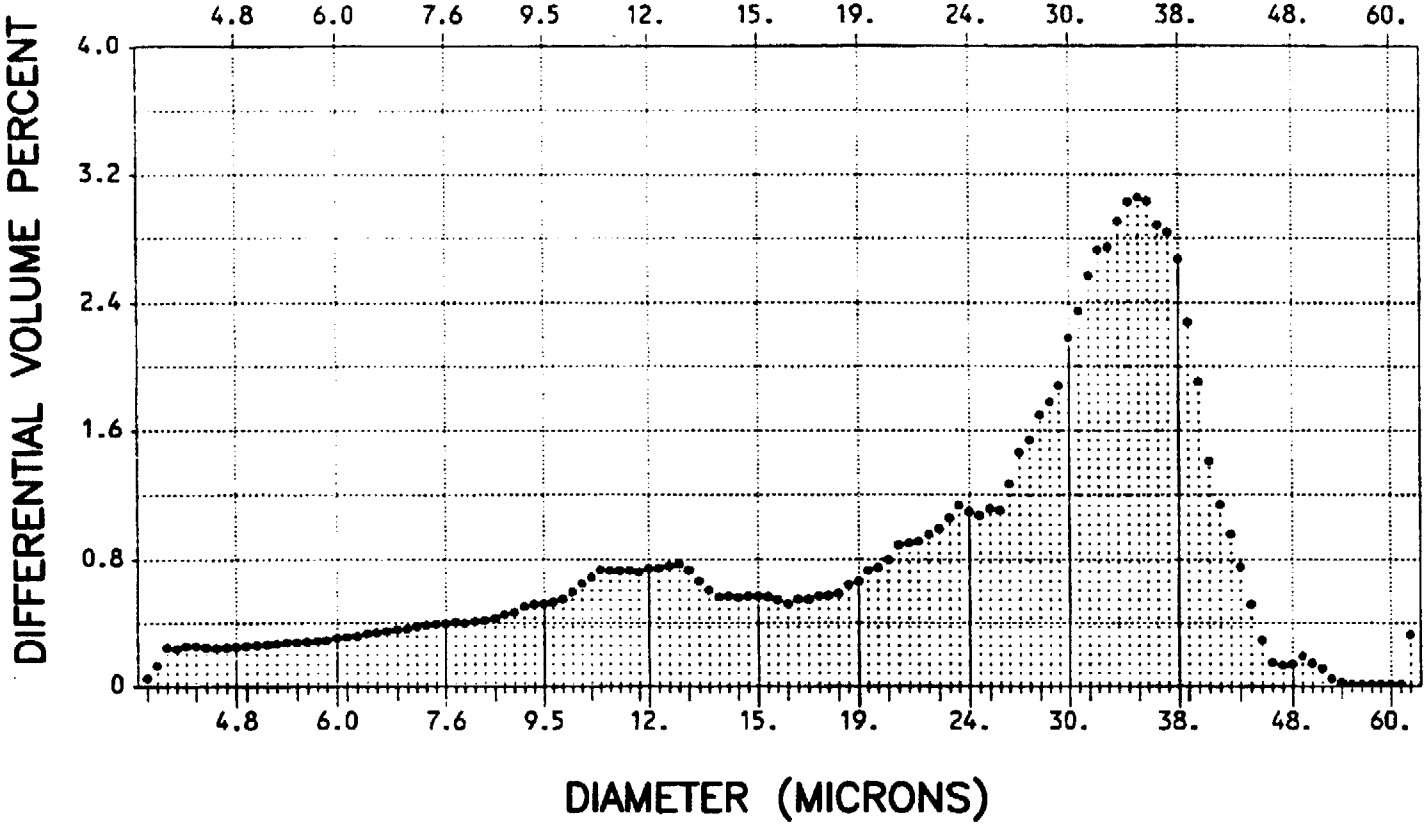
FIG. 6 is a graph of particle-size distribution of the ultra hard material after forming into a high shear compaction material sheet.

The original starting powder was mixed with organic binder and solvent to obtain a uniform dispersion. Much of the solvent was removed to leave a dry paste. The proportion of diamond powder relative to the organic solids was about 80 percent diamond and 20 percent organic binder. The dried material was then masticated in a multiple roll process to produce a sheet ten mils (0.25 mm) thick. Multiple layers of the sheet were then stacked and again masticated in the multiple roll process to produce a sheet having a thickness of 30 mils (0.75 mm). This resulted in a particle size distribution as illustrated in FIG. 6. (It may be noted when comparing FIGS. 5 and 6 that the vertical scale is different in the two graphs.)

It can be seen from FIGS. 5 and 6 that the original peaks of particle size remained essentially unchanged in location after processing. This indicates that there is little particle cleavage. On the other hand, there is a substantial increase in the proportion of fine particles, indicating that corners and edges have been broken off of the larger particles and the larger particles are thereby more rounded. This observation is confirmed by microscopic examination. The substantial increase in fine particles can also be noted from the tenth percentile of the processed material which is decreased from 12.9 to 8.21 microns.

Figure 7:
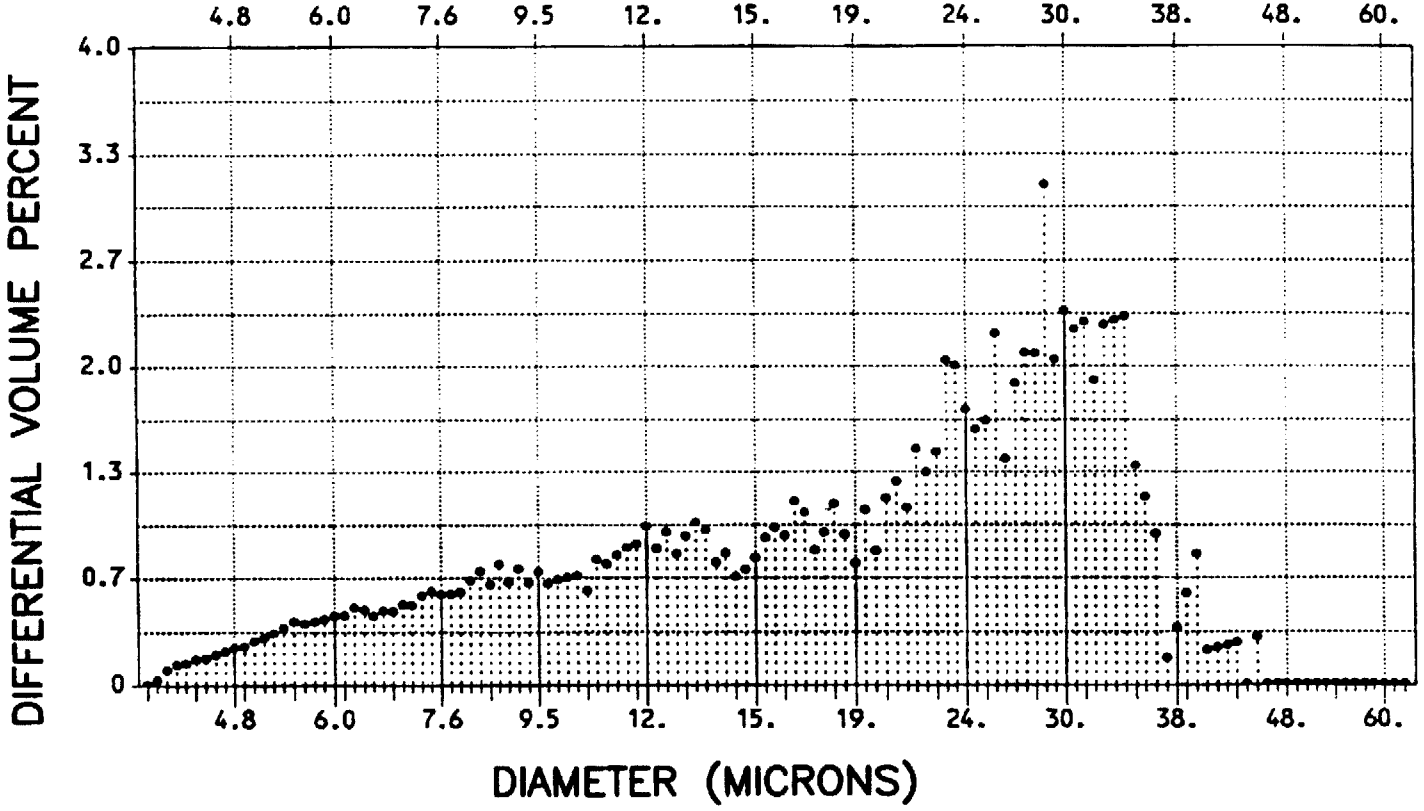
FIG. 7 is a graph of particle-size distribution of an ultra hard material following excessive mastication during making of a high shear compaction material sheet.

FIG. 7 is another graph of particle size distribution for a sample of diamond powder which was subjected to excessive high shear compaction. In this case, original peaks of particle size (which were similar to those in FIG. 5) are to a considerable extent obliterated. The particle size distribution is quite "ragged" as compared with a monotonically changing particle size distribution illustrated in FIG. 6, for example. These data indicate appreciable fracturing or cleavage of the particles due to excessive mastication. The resulting particles are angular instead of rounded. Such excessive high shear compaction is preferably avoided since the resulting polycrystalline diamond layer is less satisfactory. Rounded particles appear to result in less void volume in the final PCD.

It will also be noted that in FIG. 7 the mean particle size has been significantly changed by cleavage. This can be compared with FIG. 6 where the mean or average particle size remains more or less the same after high shear compaction as it did in the original mixture. Thus, a satisfactory amount of high shear compaction is considered to be when there is rounding of the particles without significant change in mean particle size.

The amount of high shear compaction that is satisfactory and not excessive will depend upon variables such as the original particle size, the original particle size distribution and proportion of diamond relative to binder. The best results are obtained when particles are well-rounded without a large amount of fracturing or cleavage of particles. Since the density of the resulting sheet increases with increased compaction, density can serve as a convenient measure of the desired degree of compaction. As pointed out above, it is preferred that the density or specific gravity of a sheet comprising 80 percent diamond and 20 percent binder is about 2.6±0.05 g/cm$^3$. Equivalent densities can be found for other sheets compositions. The equivalent density will also differ when the ultra hard material is cubic boron nitride instead of diamond.

When sintering diamond crystals of different sizes to form polycrystalline diamond, the thermodynamic driving force is essentially reduction in surface energy of the mixture. This is achieved through dissolution of small particles of diamond which have higher surface energy per unit volume than the larger crystals, and then reprecipitating carbon in the form of diamond on the larger crystals. Small particles continue to dissolve and migrate toward larger grains since the chemical potential of carbon atoms on a diamond grain is a function of the radius of the grain. The smaller the radius, the larger is the chemical potential of surface carbon atoms on that grain. Conversely, a larger grain having a flat surface will have minimum chemical potential of carbon atoms since the radius is infinity. Concentration of carbon atoms onto larger crystals from smaller particles reduces the total energy of the system towards a minimum.

Diamond crystals, as originally grown, generally have flat surfaces and as a result, minimum activity of carbon on the surface. On the other hand, when the diamond crystals are milled or subjected to high shear during formation of the high shear compaction sheet, some of the diamond crystals acquire somewhat rounded surfaces as corners and edges are broken off. Some may have flat cleavage surfaces. It is believed that the high shear rolling of the sheet employing an organic material not only binds the crystals into a sheet but also provides some lubrication so that crystals are not cleaved, but instead have corners and edges broken off, making the particles tend toward a rounded shape. Milled crystals are believed to be more surface active and easier to form into polycrystalline diamond than are diamond crystals as originally grown.

Rounding of the particles may also be achieved by other methods. For example, slight oxidation of diamond powder rounds the particles since the corners and edges have higher surface energy than flat faces. Heating diamond sufficiently at high temperature may also graphitize some of the diamond. This occurs first on the corners and edges for the same reasons. With these methods of forming equiaxed diamond particles, small particles for optimum packing density are not formed, and may in fact be themselves oxidized if already present. Thus, to achieve multimodal particle size distribution for high packing density, mixtures of larger and smaller particles may be employed. Formation of rounded particles and smaller particles from the corners and edges by high shear compaction is preferred, particularly since this also provides residual carbon formed in situ in the layer of ultra hard materials.

As mentioned above, the formation of residual carbon within the mass of diamond crystals due to decomposition of the organic binder also produces a high surface energy for good recrystallization and formation of polycrystalline diamond. The carbon also helps in deoxidation of the ultra hard material.

Carbon for facilitating deoxidation of the ultra hard material may also be introduced by coating particles with carbon by chemical vapor deposition or other known techniques of forming carbon. It is also possible to mix carbonaceous vapor such as methane or ethane with a reducing gas such as hydrogen or ammonia to provide carbon for facilitating deoxidation. It might be noted that when one deoxidizes diamond crystals, oxides formed on cobalt and tungsten carbide in the diamond powder are deoxidized. Cobalt and tungsten carbide are introduced into the diamond powder due to wear in the process of ball milling the powder before making the high shear compaction material sheets. Some cobalt and tungsten carbide may also be picked up from the rollers in the multiple rolling process for forming the high shear compaction material.

Figure 8:
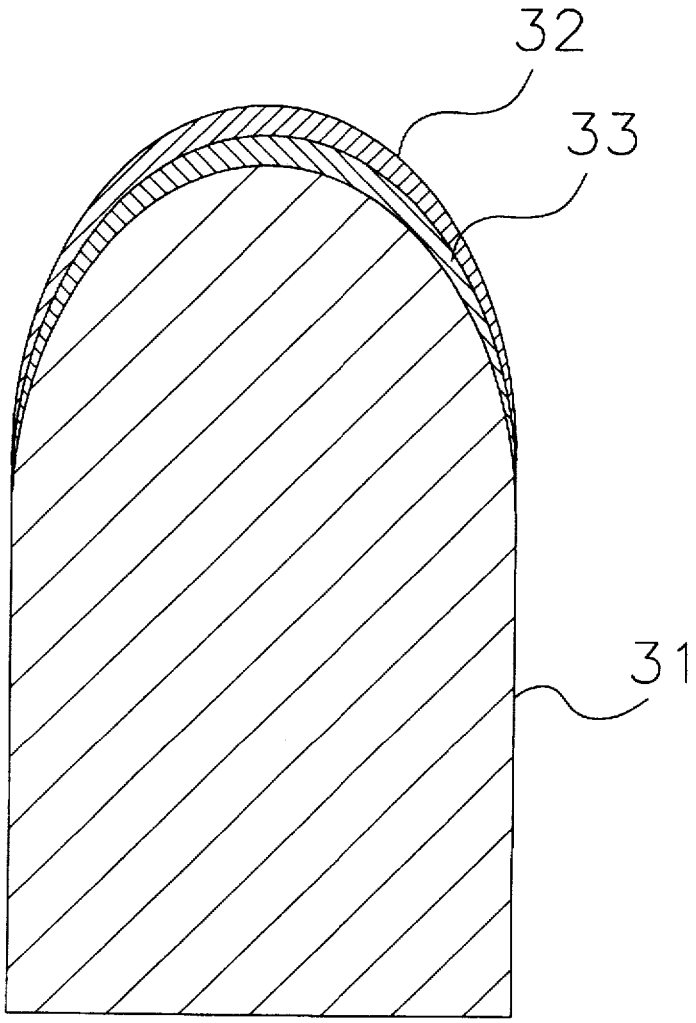
FIG. 8 is a longitudinal cross section of a rock bit insert having a polycrystalline diamond layer on one end.

The technique for forming rock bit inserts employing the high shear compaction material as described herein is particularly suitable for inserts employing a transition layer. In such an insert, as illustrated in FIG. 8 there is a cemented tungsten carbide body 31, on the rounded end of which is an outermost layer of polycrystalline diamond 32. A transition layer 33 is between the outermost PCD layer and the cemented tungsten carbide body. In such a structure, the outermost layer is substantially entirely polycrystalline diamond with some residual cobalt remaining from the sintering process.

The transition layer starts with a mixture of diamond crystals and tungsten carbide, which upon sintering forms polycrystalline diamond with tungsten carbide distributed therein and residual cobalt. Since the composition of the transition layer is intermediate between the outer layer that is entirely diamond and the body which is entirely tungsten carbide, it has an intermediate coefficient of thermal expansion and modulus of elasticity. These properties reduce the stresses between the layers and make an insert less subject to spalling under impact loads during use of a rock bit. In the embodiment illustrated, the insert has a single transition layer 33. If desired, two or more transition layers may be employed with a more gradual change in composition between the outermost PCD and the innermost body of cemented tungsten carbide.

The high shear compaction process is particularly suitable for making such an insert with a transition layer. High shear compaction sheets having different compositions are made as described above. The first layer placed in a cup for making an insert may be substantially entirely diamond crystals in the organic binder and subsequent sheets placed in the cup comprise a mixture of diamond crystals and tungsten carbide particles. This technique makes layers of substantially uniform thickness and provides smooth boundaries between adjacent layers.

An important feature of the high shear compaction sheet material is the ability to drape the sheet onto a convexly curved substrate. A complement of this is the ability to deform the sheet smoothly into a concavely curved cup. As has been mentioned, the use of a relatively larger proportion of binder tends to make the sheets more drapable. One may also increase the drapability by employing a mix of binders and plasticizers for softening the sheet. Furthermore, relatively thinner sheets tend to be more drapable. Thus, for forming layers with appreciable curvature, a well-plasticized binder and thin sheet is desirable. It turns out that very good results are obtained by using a plurality of thin sheets instead of a thick sheet.

The same result has been found on flat surfaces where a series of sheets built up to a desired thickness are as good or better than a single thicker sheet. The reason for this is not fully understood.

It is preferred to employ organic binders and plasticizers in an organic solvent for forming the high shear compaction sheet. Aqueous solvents and binders soluble in aqueous media are less desirable, particularly when the high shear compaction sheet contains cobalt, tungsten carbide or cubic boron nitride. Residual oxygen and/or water are detrimental in subsequent processing.

Exemplary binders include polyvinyl butyryl, polymethyl methacrylate, polyvinyl formol, polyvinyl chloride acetate, polyethylene, ethyl cellulose, methylabietate, paraffine wax, polypropylene carbonate, polyethyl methacrylate and the like.

Plasticizers which may be employed with such nonaqueous binders include polyethylene glycol, dibutyl phthalate, benzyl butyl phthalate, various phthalate esters, butyl stearate, glycerine, various polyalkyl glycol derivatives, diethyl oxalate, paraffine wax, triethylene glycol and various mixtures thereof.

A variety of solvents compatible with these binders and plasticizers may be used including toluene, methyl ethyl ketone, acetone, trichloroethylene, ethyl alcohol, MIBK, cyclohexane, xylene, chlorinated hydrocarbons and various mixtures thereof.

Generally speaking, it is preferable to employ binders, plasticizers and solvents which minimize the amount of oxygen, water or hydroxyl groups for minimizing oxidation in subsequent processing. For example, ethyl alcohol is less preferred because of its OH group and its azeotrope with water.

A variety of dispersant, wetting agents and homogenizers may also appear in small quantities in the mixtures used for forming the material from which the sheet is rolled.

It is found that disks having a layer of polycrystalline diamond on a cemented tungsten carbide substrate are significantly improved in two tests when made from high shear compaction sheet materials as compared with a prior technique employing diamond crystals without high shear compaction.

One of these tests is a so-called granite log abrasion test which involves machining the surface of a rotating cylinder of Barre granite. In an exemplary test, the log is rotated at an average of 630 surface feet per minute (192 MPM) past a half inch (13 mm) diameter cutting disk. There is an average depth of cut of 0.02 inch (0.5 mm) and an average removal rate of 0.023 $in^3$/second. (0.377 $cm^3$/second). The cutting tool has a back rake of 15° in the granite log abrasion test. One determines a wear ratio of the volume of log removed relative to the volume of cutting tool removed.

With a standard PCD cutting tool made without use of the high shear compaction sheet material, the wear ratio is slightly less than $1\times10^6$. A similar cutting tool made with high shear compaction sheet material for forming the polycrystalline diamond layer, produces a wear ratio of about $2\times10^6$. In other words, the tool removes about twice as much material from the granite log as the prior tool.

Another test of a tool made using the high shear compaction sheet versus a tool made without such a sheet is called a milling impact test. In this test, a half inch (13 mm) diameter circular cutting disk is mounted on a fly cutter for machining a face of a block of Barre granite. The fly cutter rotates about an axis perpendicular to the face of the granite block and travels along the length of the block so as to make a scarfing cut in one portion of the revolution of the fly cutter. This is a severe test since the cutting disk leaves the surface being cut as the fly cutter rotates and then encounters the cutting surface again each revolution.

In an exemplary test, the fly cutter was rotated at 2,800 RPM. The cutting speed was 11,000 surface feet per minute (235 MPM). The travel of the fly cutter along the length of the scarfing cut was at a rate of 50 inches per minute (1.27 MPM). The depth of the cut, i.e. the depth perpendicular to the direction of travel, was 0.1 inch (2.54 mm). The cutting path, i.e. offset of the cutting disk from the axis of the fly cutter was 1.5 inch (38 mm). The cutter had a back rake of 10°.

The measure of cutter performance employed is the length of cut before a cutter disk fails. With prior cutters wherein the layer of polycrystalline diamond is made without use of the high shear compaction technology. Cutters fail on average in about 150 inches (3.8 m). Cutters made with high shear compaction sheet cut, on average, over 185 inches before failure (4.7 m).

It is unexpected that there is increased performance in both the milling impact test and the granite log test. The general experience is that variations in processes or properties which increase the wear resistance, decrease the impact resistance and vice versa. It is unusual to find a change that increases both impact and wear resistance, and particularly where the increase is as large was found in these tests.

The description hereinabove concentrates on high shear compaction technology as applied to formation of layers of polycrystalline diamond. Residual carbon from the high temperature dewaxing of the sheet material improves the properties of the polycrystalline diamond layer. It is also found that high shear compaction sheets containing cubic boron nitride for making polycrystalline cubic boron nitride layers are improved by the high shear compaction and high temperature dewaxing. It is believed that each of two factors is significant in increasing performance. One is the rounding of CBN particles during the mastication of the high shear compaction. The other is the presence of active residual carbon remaining in the mass of CBN particles after dewaxing. It is known that a small amount of carbon enhances recrystallization and formation of polycrystalline cubic boron nitride. The high temperature dewaxing leaves such carbon in the mass of crystals and leaves the carbon in a highly active form.

Breakage of the corners and edges of the diamond or CBN particles in the course of high shear compaction may also produce conversion of some of the cubic crystal structure of the diamond or CBN to a low temperature hexagonal form of graphite or boron nitride. The presence of hexagonal phase carbon or boron nitride is believed to enhance recrystallization and formation of PCD or PCBN respectively.

In addition to thorough dewaxing and formation of residual carbon from the binder of the high shear compaction sheet, the high temperature dewaxing may also serve to reduce oxygen content of the powder before high pressure, high temperature pressing. Oxygen, particularly when pressing CBN, is considered to be detrimental to formation of good polycrystalline ultra hard material. The binders employed in the sheet often include oxygen in the molecule. It is believed that temperatures in excess of 950° C. in vacuum are needed for removing oxides. Higher or lower temperatures may be appropriate for removing oxides with hydrogen or ammonia, or when the ultra hard material is CBN instead of diamond.

Some combination of the advantages of high shear compaction material for forming polycrystalline ultra hard material enables formation of such polycrystalline material with considerably larger and considerably smaller crystal sizes than previously feasible. For example, prior practice has been limited to formation of polycrystalline diamond with average particle sizes appreciably larger than one micron. Commercial products with particle sizes as small as two microns are not known. Cubic boron nitride forms good polycrystalline material with an average particle size of about eight microns. Two micron average particle size material does not form a polycrystalline material with good properties. Good properties are not obtained with such small particle sizes, possibly because of the large surface area that may be contaminated.

Regardless, following high shear compaction, dewaxing and deoxidation as described, diamond or CBN with an average particle size as small as about one micron can be formed into polycrystalline material with high hardness.

Furthermore, previous commercial products have employed average particle sizes of no more than about 90 microns. Large particle size polycrystalline materials have good toughness and are desirable, but not previously achieved. Following high shear compaction, dewaxing and deoxidation at high temperature, good polycrystalline ultra hard material may be made with average particle sizes greater than 100 microns.

It will also be apparent that the high shear compaction sheet can be pressed with a punch and die for forming complex shapes such as may be required for forming a PCD layer on a chisel insert for a rock bit, for example. Formation of various shapes from high shear compaction sheet also provides the user with an opportunity to automate processes that cannot presently be automated because of use of "loose" powder.

With or without such automation, the high shear compaction sheet material produces a higher quality, more consistent part. For example, in one type of flat compact made with a layer of PCD 0.75 mm thick, the variation in thickness is about ±38 microns. By employing high shear compaction sheet material to form the same product, the variation in thickness is about ⅓ as much.

Since the high shear compaction material may be in sheets, ropes or shaped parts, the term "layer" is used herein to refer to such raw material or the parts produced therefrom, regardless of whether in uniform thickness across the layer.

Although this invention has been described in certain specific embodiments, many additional modifications and variations will be apparent to those skilled in the art. It is therefore to be understood that within the scope of the appended claims, this invention may be practiced otherwise than as specifically described.

What is claimed is:

1. A method of forming a polycrystalline ultra hard material comprising the steps of:

placing a layer of high shear compaction material comprising ultra hard particles and an organic binder adjacent to a cemented metal carbide substrate;

heating to a temperature greater than 1000° C. for removing the organic binder, thereby leaving an ultra hard material layer; and processing the ultra hard material layer and the metal carbide substrate in a high pressure, high temperature apparatus, for forming a polycrystalline ultra hard layer bonded to the cemented metal carbide substrate.

2. A method according to claim 1 wherein the heating step comprises heating the layer to a sufficient temperature to form graphite or amorphous carbon.

3. A method of forming a polycrystalline ultra hard material comprising the steps of:

placing a layer of high shear compaction material comprising ultra hard particles and an organic binder adjacent to a cemented metal carbide substrate;

heating to a temperature of about 1025° C. for removing the organic binder, thereby leaving an ultra hard material layer; and processing the ultra hard material layer and the metal carbide substrate in a high pressure, high temperature apparatus, for forming a polycrystalline ultra hard layer bonded to the cemented metal carbide substrate.

4. A method of forming a polycrystalline ultra hard material comprising the steps of:

placing a layer of high shear compaction material comprising ultra hard particles and an organic binder adjacent to a cemented metal carbide substrate;

heating to a temperature of about 500° C., holding a temperature of about 500° C. for about two hours and then heating to at least 950° C. for removing the organic binder, thereby leaving an ultra hard material layer; and processing the ultra hard material layer and the metal carbide substrate in a high pressure, high temperature apparatus, for forming a polycrystalline ultra hard layer bonded to the cemented metal carbide substrate.

5. A method of forming a polycrystalline ultra hard material comprising the steps of:

placing a layer of high shear compaction material comprising ultra hard particles and an organic binder adjacent to a cemented metal carbide substrate;

heating with a heating rate in the order of 2° C. per minute to a temperature of 500° C., holding a temperature of 500° C. for about two hours, then heating to a temperature of about 950° C. at a heating rate not greater than 5° C. for removing the organic binder, thereby leaving an ultra hard material layer; and processing the ultra hard material layer and the metal carbide substrate in a high pressure, high temperature apparatus, for forming a polycrystalline ultra hard layer bonded to the cemented metal carbide substrate.

6. A method of forming a polycrystalline ultra hard material layer bonded to a metal carbide substrate comprising the steps of:

forming a layer of high shear compaction material comprising ultra hard particles and an organic binder, the layer of high shear compaction material having been formed by a multiple roller process with sufficient shear for limiting mastication for rounding particles in the high shear compaction material;

heating for removing the organic binder, thereby leaving an ultra hard material layer; and processing the ultra hard particle layer in a high pressure, high temperature apparatus for forming a polycrystalline ultra hard layer.

7. A method according to claim 6 in which the particle size distribution of the ultra hard particles in the high shear compaction material comprises a first portion of particles with a relatively smaller average diameter and a second portion of particles with a relatively larger average diameter, a larger portion of the particles having a larger average diameter.

8. A method according to claim 6 in which the ultra hard layer includes a material selected from the group consisting of graphite and amorphous carbon.

9. A method according to claim 6 further comprising forming a second layer of high shear compaction material comprising ultra hard particles, metal carbide particles and an organic binder between the first high shear compaction material layer and a metal carbide substrate for forming a transition layer between the polycrystalline ultra hard layer and the metal carbide substrate, the transition layer comprising the ultra hard material and metal carbide particles.

10. A method of forming a polycrystalline ultra hard material layer bonded to a metal carbide substrate comprising the steps of:

forming a layer of high shear compaction material comprising ultra hard particles and an organic binder wherein the density of the high shear compaction material is in the range of 2.55 to 2.65 g/cm$^3$, the layer of high shear compaction material having been formed by a multiple roller process with sufficient shear for rounding particles in the high shear compaction material;

heating for removing the organic binder, thereby leaving an ultra hard material layer; and processing the ultra hard particle layer in a high pressure, high temperature apparatus for forming a polycrystalline ultra hard layer.

11. A method of forming a polycrystalline ultra hard particle layer comprising the steps of:

forming a layer of a high shear compaction material comprising ultra hard particles and an organic binder;

heating the binder at a temperature exceeding 1000° C. forming low temperature stable carbon in the resulting ultra hard layer; and processing the ultra hard particle layer in a high pressure, high temperature apparatus, for forming a polycrystalline ultra hard layer.

12. A method according to claim 11 in which the particle size distribution of the ultra hard particles in the high shear compaction material comprises a first portion of particles with a relatively smaller average diameter and a second portion of particles with a relatively larger average diameter, a larger portion of the particles having the larger average diameter.

13. A method of forming a polycrystalline ultra hard material layer comprising the steps of:

rounding particles of ultra hard material;

forming a layer of the rounded ultra hard particles containing non-diamond carbon distributed throughout the layer; and processing the ultra hard particle layer in a high pressure, high temperature apparatus, for forming a polycrystalline ultra hard layer.

14. A method according to claim 13 comprising the step of forming the layer with a mixture of rounded ultra hard particles having a multimodal average particle size distribution.

15. A method according to claim 13 comprising the step of:

distributing carbon throughout the layer by rolling ultra hard particles in a multiple roller high shear compaction process with an organic binder and decomposing the binder at elevated temperature for leaving residual carbon in the layer.

16. A method according to claim 13 wherein the carbon is located on the surface of the ultra hard material.

17. A method of forming a polycrystalline ultra hard material comprising the steps of:

commingling organic binder and ultra hard material particles;

rolling the commingled binder and particles in a multiple roller process a sufficient amount for breaking smaller particles from the corners and edges of the ultra hard material particles, rounding the ultra hard material particles and forming a layer of high shear compaction material;

placing the layer of high shear compaction material adjacent to a cemented metal carbide substrate;

heating for removing the organic binder, thereby leaving an ultra hard material layer; and processing the ultra hard material layer and the metal carbide substrate in a high pressure, high temperature apparatus, for forming a polycrystalline ultra hard layer bonded to the cemented metal carbide substrate.

18. A method according to claim 17 wherein the commingling step comprises mixing a first portion of particles of ultra hard material with a relatively smaller average size and a second portion of particles of ultra hard material with a relatively larger average size with the binder.

* * * * *